US005476263A

United States Patent [19]

Romaniello

[11] Patent Number: 5,476,263

[45] Date of Patent: Dec. 19, 1995

[54] TABLE GAME SIMULATING THE DEVELOPMENT OF A SPORTS CHAMPIONSHIP

[76] Inventor: Luciano Romaniello, Corso Sempione, 70, I-20154 Milano, Italy

[21] Appl. No.: 408,575

[22] Filed: Mar. 22, 1995

[30] Foreign Application Priority Data

Mar. 25, 1994 [IT] Italy ..... MI94U0225 U

[51] Int. Cl.[6] ..... A63F 3/00

[52] U.S. Cl. ..... 273/244; 273/249

[58] Field of Search ..... 273/242, 243, 273/244, 248, 249

[56] References Cited

U.S. PATENT DOCUMENTS

| | | | |
|---|---|---|---|
| 1,661,216 | 3/1928 | Destefano | 273/244 |
| 5,280,912 | 1/1994 | Porter | 273/244 |
| 5,295,834 | 3/1994 | Saunders | 273/249 X |
| 5,383,669 | 1/1995 | Vance | 273/244 |

*Primary Examiner*—William E. Stoll
*Attorney, Agent, or Firm*—Browdy and Neimark

[57] ABSTRACT

A table game simulating the development of a sports championship, comprising a game board (1), a path of travel (2) defined on the game board (1), zones (3) formed on the path of travel (2) and consecutive to each other, pieces (5) to be positioned in the zones (3), and drawing devices (11, 12) adapted to determine the position of pieces (5), the path of travel (2) being divided into two consecutive half-paths (2*a*, 2*b*) having an equal number of zones (3) and corresponding to the first and second rounds of a sports championship engaging a plurality of teams, the zones (3) comprising in each half-paths (2*a*, 2*b*), as many team-boxes (4) as there are teams, the team-boxes (4) each having an identification symbol (4*a*) of their own, and the pieces comprising as many team-pieces (5) as there are team-boxes (4) in each half-path (2*a*, 2*b*), each of the team-pieces (5) having an identification symbol (4*a*) of said team-box (4) .

9 Claims, 3 Drawing Sheets

TABLE GAME SIMULATING THE DEVELOPMENT OF A SPORTS CHAMPIONSHIP

BACKGROUND OF THE INVENTION

The present invention relates to a table game simulating the development of a sports championship, for example soccer, basketball, volleyball, hockey, rugby, football or water polo championships.

The table game is of the type comprising a game board, a path of travel defined in said game board, zones formed on said path of travel and consecutive to each other, pieces to be positioned in said zones, and drawing means adapted to determine the position of said pieces on said path of travel.

Table games are known in which, through an appropriate structure comprising a game surface and other components, games simulating sports competitions are played following appropriate rules.

Most of these table games simulating sports events are either of the type in which through simulacra or player symbols a game is played on a reproduction of a playground, or of the type in which a competition is started by moving pieces or tokens along a marked-off path.

In both cases a single match or game at a time can be substantially made, usually between two teams alone.

For this table games a lot of time is required for executing championships or tournaments between a great number of teams, in which only at the end a winning team comes out, as a result of a great number of matches or games.

In fact it is necessary to execute as many individual games as there are matches between the different teams provided in the championship that one wishes to simulate.

By so doing, the tournament or championship can even last several days, and it is likely to lose interest as time goes by and the simulation of a complete championship is not possible concurrently with occasional meetings between friends.

On the other hand, it is known that sometimes interest in sports competitions is addressed more to the final result of a championship including a great number of games than to the outcome of individual games or competitions.

SUMMARY OF THE INVENTION

Under this situation the present invention generally aims to devise a table game capable of simulating the execution of a complete sports championship in a single play interval or stage, by simultaneously involving many teams and players. Within this general aim it is an important object of the invention to devise a game which can be readily adapted to several types of sports championships, such as for example soccer, basketball, volleyball, hockey, rugby, football, water polo championships.

Another important object is to devise a table game that, while concerning the execution of a championship as a whole, also brings out and emphisizes individual matches between the participants in the game.

Another object of the invention is to provide a table game simulating a sports championship in a lively and realistic manner and also capable of being influenced by the result of actual matches when the game is played simultaneously with said actual matches, for example when the game is played during a live broadcasting on radio or television.

The above objects are substantially achieved by a table game simulating the development of a sports championship comprising: a game board, a path of travel defined on said game board, zones formed on said path of travel and consecutive to each other, pieces to be positioned in said zones and drawing means adapted to determine the position of said pieces on said path of travel, said path being divided into two consecutive half-paths substantially having an equal number of said zones and corresponding to the first and second rounds of a sports championship engaging a plurality of teams, said zones comprising in each of said half-paths, as many team-boxes as there are teams, said team-boxes each having an identification symbol of their own and said pieces comprising as many team-pieces as there are team-boxes in each said half-path, each of said team-pieces having an identification symbol corresponding to an identification symbol of a said team-box.

BRIEF DESCRIPTION OF THE DRAWINGS

Further features and advantages of the invention will become more apparent from the following description of an embodiment of the inventive table game given hereinafter with reference to the accompanying drawings, in which.

DETAILED DESCRIPTION OF THE INVENTION

Figure 1:
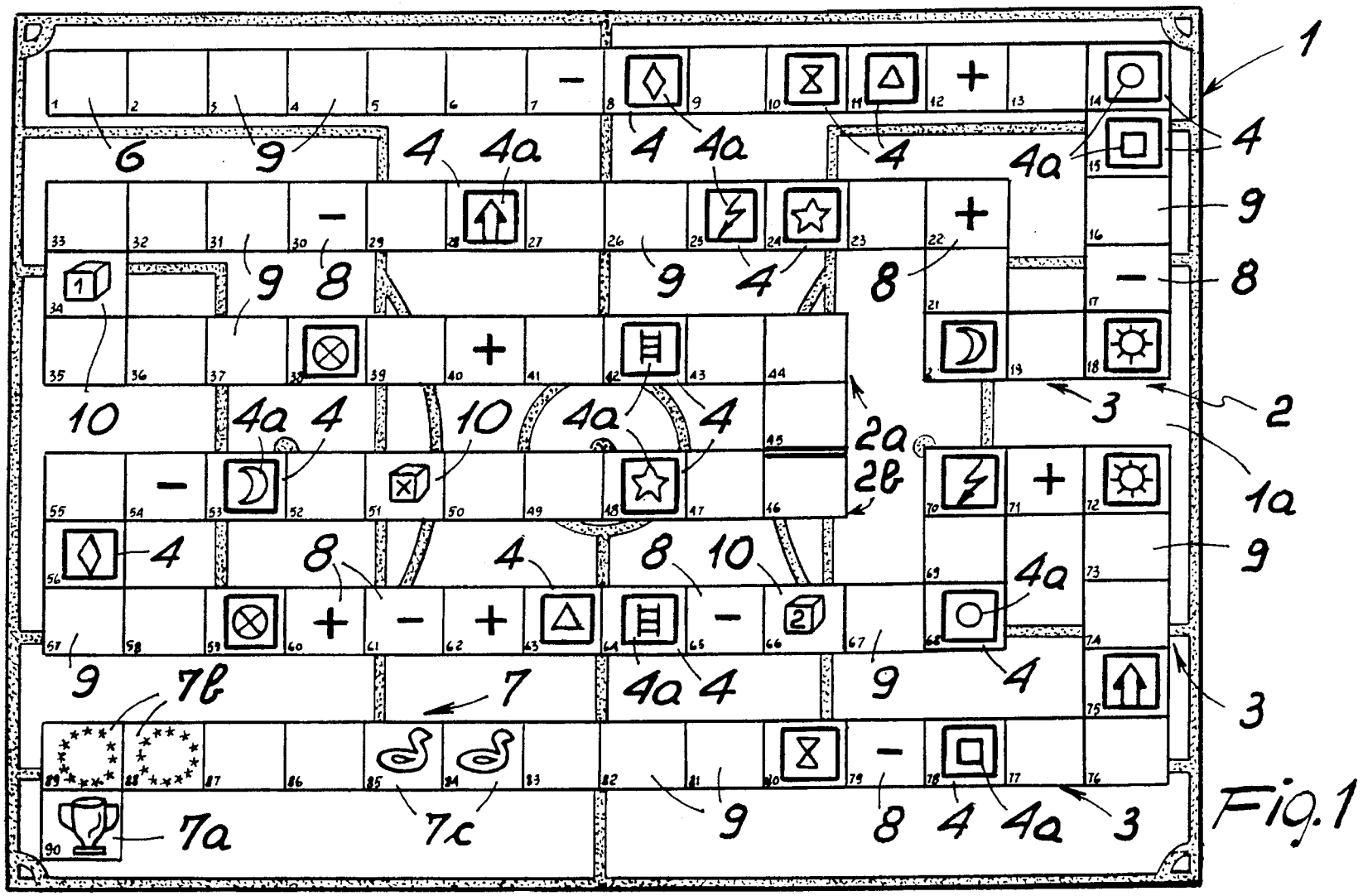
FIG. 1 represents a game board showing a path printed on the reproduction of a soccer field, by way of example.

Referring to the drawings, the table game described by way of example is of the type simulating the development of a soccer championship in which twelve teams take part and they encounter each other both in a first and a second round. This table game comprises a game board 1 made of paperboard for example and defining a game surface 1*a*.

The game surface la of the board 1 is such printed as to represent a soccer field, as discernible from FIG. 1, and overprinted on this soccer field representation is a path 2 defining a tortuous route consisting of zones 3 consecutive to each other and progressively numbered.

Zones 3 preferably are in a number included between fifty and one hundred and fifty and the number is selected so that it is adapted to determine a playing time the overall duration of which is the same as that of a true stage of a championship.

Since matches of a soccer championship are played each week mostly simultaneously with one another, and since each match has a theoretical duration of ninety minutes, in the example shown ninety zones 3 are provided for a game duration of about ninety minutes.

In addition, path 2 is divided into two half-paths having the same number of zones 3: a first half-path 2*a* is formed of fourty-five zones 3 and defines a first round of said championship, and a second half-path 2*b* defines a second round.

Zones 3 are pratically formed of several boxes substantially identical with each other as regards sizes and in particular team-boxes 4 are distinguishable among said boxes.

These team-boxes 4 are disposed on each half-path 2*a*, 2*b* in a number corresponding to that of the true teams running the championship that one wishes to simulate.

In addition they each carry their own identification symbol 4*a* preferably the same as, or similar to the badge of said true teams.

Since in the case shown a soccer championship formed of twelve teams has been supposed by way of example, twelve team-boxes 4 are provided on the first half-path 2*a* and twelve identical team-boxes 4 are provided on the second half-path 2*b*.

As shown in this case, it is not necessary that in the two half-paths the identical team-boxes 4 should exactly occupy the same positions.

Figure 2:
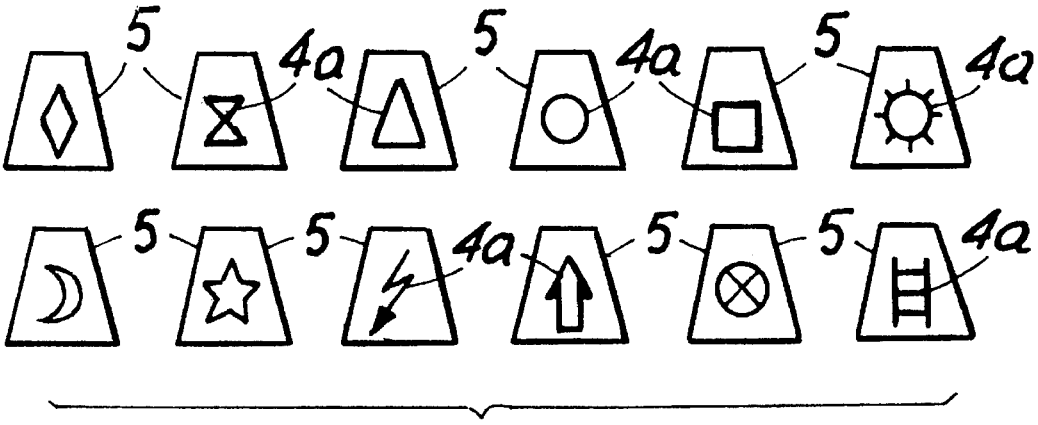
FIG. 2 diagrammatically shows the different pieces to be used on the board in FIG. 1.
Figure 3:
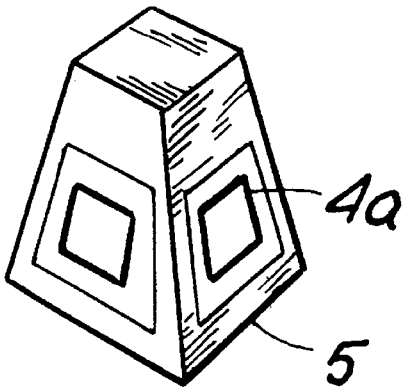
FIG. 3 is a perspective view of one of the pieces of FIG. 2.

Then pieces all consisting of team-pieces 5 closely correlated with the team-boxes 4 are provided: as shown in FIGS. 2 and 3 the team-pieces 5 are in the same number as the team-boxes 4 of each half-path 2*a*, 2*b*, twelve in the case herein shown, and have the same identification symbols 4*a* as the team-boxes 4.

Practically the team-boxes 4 and team-pieces 5 represent and symbolize the same teams.

Also provided on path 2 are other boxes that are alternated with and interposed between the team-boxes 4 at random. It is possible to identify one start box 6, a plurality of finish boxes 7, advantage boxes and disadvantage boxes 8, passage boxes 9 and forecast boxes 10.

In detail, the start box 6 is located at the beginning of the first half-path 2*a* and the finish boxes 7 are located at the end of the second half-path 2*b* and comprise one champion box 7*a*, two placing boxes 7*b* located immediately following the champion box 7*a* and for example displaying the right to take part in international competitions, and the salvation boxes 7*c* showing placings after which penalties can occur in accordance with the provisions of the rules in the championship one wishes to simulate.

The champion box 7*a* carries the symbol of a cup, for example, the placing boxes 7*b* carry the symbol of the European flag, for example, and the salvation boxes 7*c* carry the symbol of a life buoy, for example.

The advantage and disadvantage boxes 8 are correlated with awards and penalties in advancing and are distinguished in FIG. 1 by specific marks.

Passage boxes 9, reproduced in FIG. 1 devoid of distinction elements for the sake of simplicity, can be identified by depictions showing events connected with the championship or the game, or also humurous depictions displaying the usual jargon of sports reporters.

The forecast boxes 10 in FIG. 1 selectively show one of the typical marks 1, X, 2 indicating the victory of the home team, a draw, or the victory of the out-of-home team, respectively.

Figure 4:
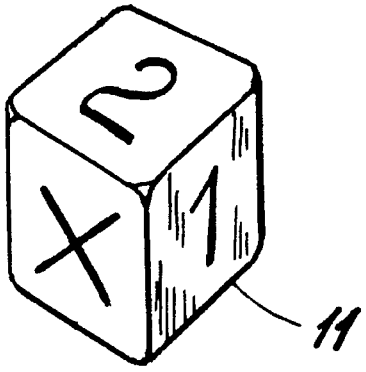
FIG. 4 is a perspective view of one forecast die of the table game according to the invention.

The forecast boxes 10 are coupled with a special six-faced forecast die 11, shown in FIG. 4, on which said marks 1, X, are imprinted.

Figure 5:
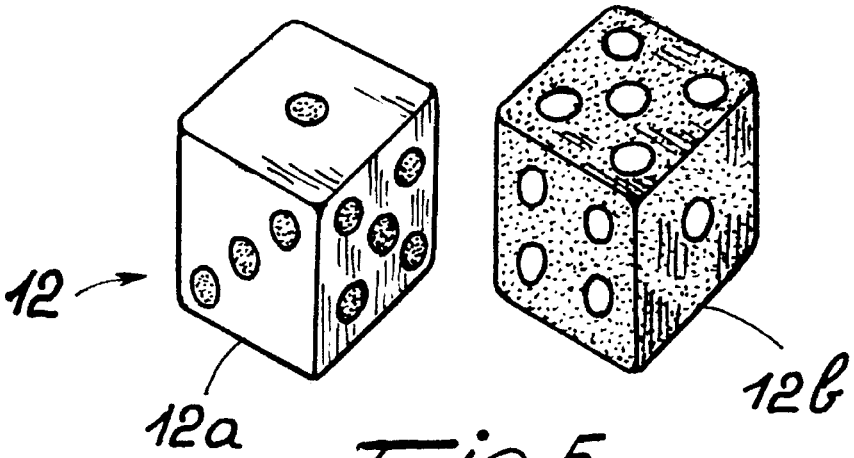
FIG. 5 shows two further game dice.

The table game in fact comprises drawing means embodied both by said forecast die 11, and by two game dice 12 of the traditional type but of different colours, one white 12*a* and one red 12*b* for example, shown in FIG. 5.

Figure 7:
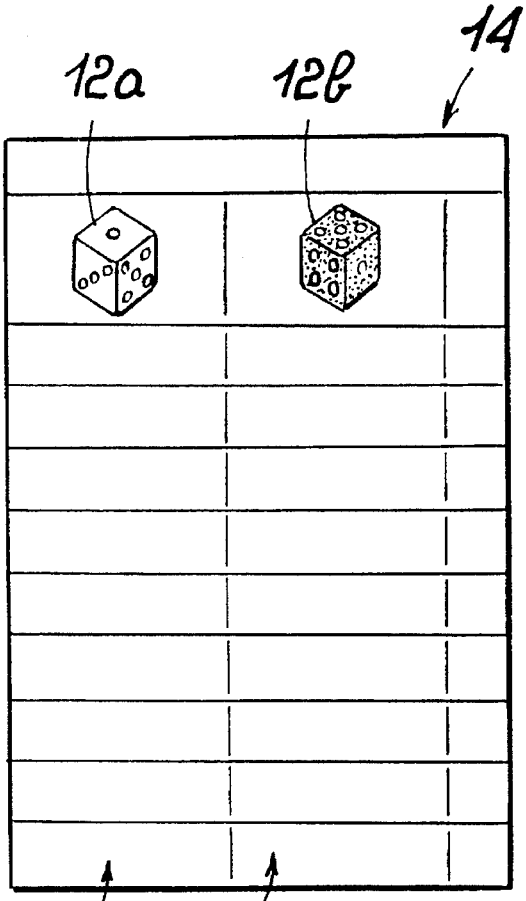
FIG. 7 shows a first type of schedule of the game according to the invention.
Figure 8:
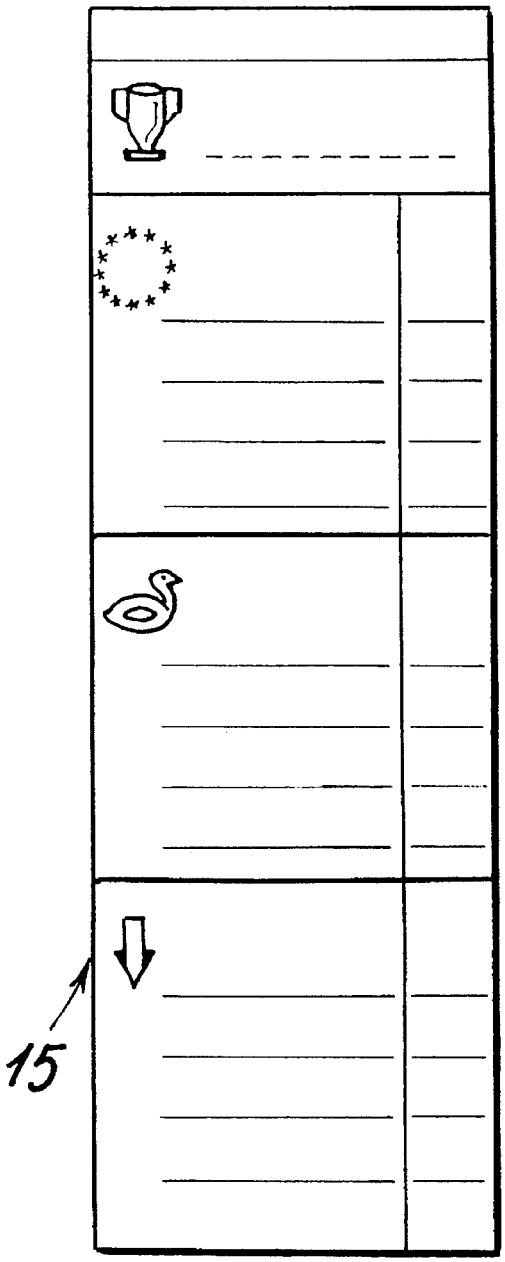
FIG. 8 shows a second type of schedule for the inventive game.
Figure 6:
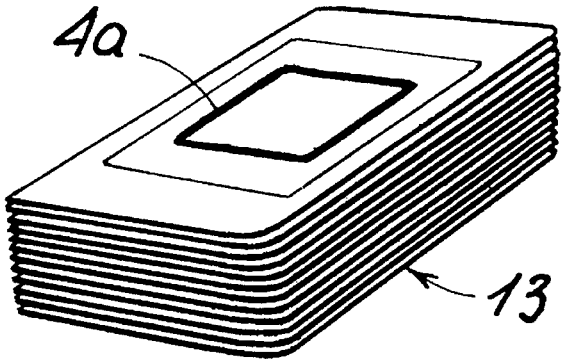
FIG. 6 shows cards specifically belonging to the table game.

FIGS. 6, 7, 8 then show that the table game comprises a pack of cards 13 each reproducing the identification symbol 4*a* of one of the playing teams, and a first schedule 14 and a second schedule 15 on which the turns for throwing the dice, the drawn results and the position and scored points of the different teams are to be recorded and organized. The first schedule 14 has two columns disposed side by side, denoted by 14*a* and 14*b* and marked by dice 12*a* and 12b respectively.

One play example of the table game according to the invention is now described.

The soccer, basketball, volleyball, hockey, rugby, football, or water polo teams will be coupled with the players taking part in the game and if the number of players is less than that of the teams, the surplus teams will be chosen by lot and given out.

Each player then will take one card 13 carrying the identification symbol 4*a* of the team that is coupled with her/him, and the order in which dice are to be thrown will be drawn.

Afterwards schedule 14 is filled in, the different teams being put in columns 14*a* and 14*b*, following the turn order for throwing the dice.

In this manner each player in the adjacent row will find one team coupled with another player and each player will be coupled with a white or a red die.

The arrangement will remain unchanged during the whole game and each player when it is her/his turn will throw the die 12 the color of which is coupled with the column in which the team that must move is located.

At this point the game begins and by throwing the dice 12 in turn the players will move their team-piece 5 through a number of zones corresponding to the drawn number.

At each dice throwing, the team-pieces 5 will stop in a box of the path 2 and if there are indications therein, these indications will be observed.

For example in advantage or disadvantage boxes 8 an advantage or a disadvantage will be received.

The player stopping in one of the forecast boxes 10 will pick up one forecast die 11 and one game die 12 and will throw them together: if throwing of the forecast die 11 shows the same mark as that on the forecast box 10 where the team-piece 5 has stopped, the piece will move through a number of boxes corresponding to the number appeared on the die 12.

If on the contrary the forecast die 11 shows a different mark, the piece stays unmoved.

The champion box 7*a* stating which is the champion team in the involved tournament or championship will be occupied only as a result of an exact-value throw. Should that not be the case, the piece will go back retracing its steps until the points resulting from throwing the die have been consumed.

The fundamental boxes in the table game of the invention are team-boxes 4.

These boxes cause direct encounters between the playing teams.

Each encounter takes place when a team-piece 5 stops in team-box 4 having an identification symbol 4*a* different from its own symbol and this encounter occurs between the players coupled with said team-piece and team-box, respectively.

In one simplified execution of said encounter, each player will throw one die 12 and the encounter is won by the player that will obtain the higher number: she/he will be entitled to move her/his own piece forward through a number of boxes corresponding to the number issued with her/his die. In case of even score, neither of them will be entitled to move her/his piece.

In a second execution of said encounter, the forecast die 11 is used too, bearing in mind that mark 1 is always coupled with the team-box 4 where the encounter takes place whereas mark 2 is coupled with the team-piece 5 stopping in that team-box 4.

At the time of the encounter, the following steps take place: the player coupled with the team-box 4 takes the forecast die 11 whereas the player coupled with the team-piece 5 takes one die 12 and both throw the respective dice.

The following results may be reached. If the forecast die 11 shows mark 1 and the traditional die 12 shows three for example, the player of the team-box 4 is the winner and her/his piece irrespective of where it is, moves forward through three cases.

If the forecast die 11 shows mark 2 and the traditional die 12 shows number four for example, the player of the team-piece 5 is the winner and her/his piece moves forward through four cases.

If the forecast die 11 shows mark X neither of them is the winner and both players do not move their respective pieces.

In addition, it is also to be noted that the game development may be also associated with the progress of the matches that are being played during a championship day, by virtue of the fact that the number of the zones 3 is such provided that the game has a duration substantially corresponding to the duration of a campionship stage.

In this case the initial filing in of the first schedule 14 must follow the order of the official calendar encounters of the actual championship day.

The actual playing teams therefore will influence the simulation.

For example, in a soccer campionship, the events may be goals, own goals, poles, crossbars, granted penalties, saved shots, scored goals from free kicks, cautions, expulsions, and they will represent as many chances, awards or disadvantages to be applied immediately to the teams engaged in simulating the same championship.

I claim:

1. A table game simulating the development of a sports championship, comprising:

a game board, a path of travel defined on said game board, zones formed on said path of travel and consecutive to each other, pieces to be positioned in said zones, and drawing means adapted to determine the position of said pieces on said path of travel, said path of travel being divided into two consecutive half-paths substantially having an equal number of said zones and corresponding to the first and second rounds of sports championship engaging a plurality of teams, said zones comprising in each of said half-paths, as many team-boxes as there are said teams, said team-boxes each having an identification symbol of their own, and said pieces comprising as many team-pieces as there are team-boxes in each said half-path, each of said team-pieces having an identification symbol corresponding to an identification symbol of said team-box.

2. The table game as claimed in claim 1, in which said path of travel is overprinted on a stylized reproduction of a playground.

3. The table game as claimed in claim 1, in which in said path of travel said zones further comprise forecast boxes selectively showing marks 1, X, 2 and in which said drawing means comprises one forecast die reproducing said marks 1, X, 2 on its faces.

4. The table game as claimed in claim 1, in which said drawing means comprises two game dice of the traditional type of different colors and one forecast die reproducing marks 1, X, 2 on its faces.

5. The table game as claimed in claim 1, in which in said path of travel said zones further comprise a plurality of finish boxes displaying placings and final awards provided in said championship.

6. The table game as claimed in claim 1, in which in said path of travel said zones further comprise advantage and disadvantage boxes correlated with awards and penalties respectively, said advantage and disadvantage boxes being identified by specific marks.

7. The table game as claimed in claim 1, in which in said path of travel said zones further comprise passage boxes identified by depictions showing events connected with said championship.

8. The table game as claimed in claim 1, in which there are cards each reproducing one said identification symbol of one of said teams taking part in said championship, a first schedule adapted to enable recording of at least turns of play, and a second schedule adapted to enable recording of at least the positions of said playing teams.

9. The table game as claimed in claim 1, in which in said path of travel said zones are provided in a number adapted to determine an overall playing time of substantially the same duration as that of a true championship stage, to play a game simultaneously to said true championship stage.

* * * * *